US009175920B2

(12) United States Patent
Moore

(10) Patent No.: US 9,175,920 B2
(45) Date of Patent: Nov. 3, 2015

(54) SOUND SUPPRESSOR FOR A FIREARM

(71) Applicant: FN America, LLC, McLean, VA (US)

(72) Inventor: Charles A. Moore, Columbia, SC (US)

(73) Assignee: FN AMERICA, LLC, McLean, VA (US)

( * ) Notice: Subject to any disclaimer, the term of this patent is extended or adjusted under 35 U.S.C. 154(b) by 0 days.

(21) Appl. No.: 14/521,875

(22) Filed: Oct. 23, 2014

(65) Prior Publication Data

US 2015/0136519 A1 May 21, 2015

Related U.S. Application Data

(60) Provisional application No. 61/906,139, filed on Nov. 19, 2013.

(51) Int. Cl.
*F24F 13/24* (2006.01)
*F41A 21/30* (2006.01)

(52) U.S. Cl.
CPC ..... *F41A 21/30* (2013.01)

(58) Field of Classification Search
CPC ..... F24F 13/24
USPC ..... 181/223; 89/14.4
See application file for complete search history.

(56) References Cited

U.S. PATENT DOCUMENTS

| | | | | |
|---|---|---|---|---|
| 4,576,083 | A * | 3/1986 | Seberger, Jr. | 89/14.4 |
| 7,325,474 | B2 * | 2/2008 | Yoshimura et al. | 89/14.4 |
| 8,047,115 | B2 | 11/2011 | Noveske | |
| 8,100,224 | B1 | 1/2012 | Olson | |
| 8,167,084 | B1 * | 5/2012 | Moore | 181/223 |
| 8,490,534 | B1 * | 7/2013 | Moore | 89/14.2 |
| 8,490,535 | B1 * | 7/2013 | Moore et al. | 89/14.2 |
| 8,499,676 | B1 * | 8/2013 | Moore et al. | 89/14.2 |
| 2005/0126382 | A1 * | 6/2005 | Yoshimura et al. | 89/14.4 |
| 2010/0163336 | A1 | 7/2010 | Presz | |
| 2013/0061503 | A1 | 3/2013 | W. et al. | |
| 2013/0180796 | A1 * | 7/2013 | Dueck et al. | 181/223 |
| 2013/0340313 | A1 * | 12/2013 | Myers et al. | 42/90 |
| 2014/0231168 | A1 * | 8/2014 | Dueck et al. | 181/223 |
| 2014/0299405 | A1 * | 10/2014 | Miller et al. | 181/223 |
| 2014/0318887 | A1 * | 10/2014 | Latka | 181/223 |

* cited by examiner

*Primary Examiner* — Forrest M Phillips
(74) *Attorney, Agent, or Firm* — Michael A. Mann; Nexsen Pruet, LLC

(57) ABSTRACT

A sound suppressor for a firearm with a high rate of fire, such as a machine gun, conceals the location of the firearm during heavy use by rapidly dissipating heat through a foamed carbon core. A sound suppressing baffle core is coaxially located within a tubular housing, having flared ends extending beyond the core. An inlet nozzle and exit place close the ends of the suppressor and are held in place with threaded collars. The terminal portions of the collars are beveled, as are the corresponding terminal portions of the nozzle and end plate, and are used to capture the flared portions of the ends of the tubular housing. Diagonally opposing recesses in the collars enable their removal with a spanner wrench, along with the other components for maintenance and replacement. The suppressor lasts longer and has a less visible heat signature used in sustained fire on a machine gun.

15 Claims, 2 Drawing Sheets

SOUND SUPPRESSOR FOR A FIREARM

PRIORITY CLAIM

The benefit of U.S. provisional patent application Ser. No. 61/906139, filed Nov. 19, 2013, is claimed, which application is incorporated herein in its entirety by reference.

BACKGROUND OF THE INVENTION

A sound suppressor is intended to conceal the location of a gun when fired. When undergoing sustained fire, however, a gun, such as a machine gun, and its suppressor become hot, hot enough to glow a dull red, and therefore visible on a dark night. In addition, suppressors are subject to internal damage when a fired bullet does not pass cleanly through it. Slight impacts of the bullet damage the suppressor and firing residue deposits bits of metal inside it. In time, incremental build-up of these deposits, damage from bullet impacts, and heat deformation make frequent repair or replacement of suppressors inevitable. Perhaps more importantly, the ability of the suppressor to shed heat during sustained fire degrades its ability to conceal the location of a machine gun.

SUMMARY OF THE INVENTION

According to its major aspects and briefly recited, the present invention is a sound suppressor for a firearm, particularly for one capable of sustained firing, such as a machine gun. The suppressor is designed to be disassembled for maintenance and repair so that, when appropriate, only damaged components need to be replaced and all parts will last longer than otherwise.

Additionally, the present suppressor takes advantage of the heat transfer capabilities of graphite foam. Not only does the foam reduce the heat signature of the firearm when undergoing sustained firing but, by keeping all the components cooler, reduces damage to components both directly and indirectly from heat deformation to a surprising extent.

Those familiar with the art of suppressors and other components for firearms will take note of these and other features and their advantages of the present invention in a careful reading the following detailed description accompanied by the following drawings.

DESCRIPTION OF PREFERRED EMBODIMENTS

Figure 1:
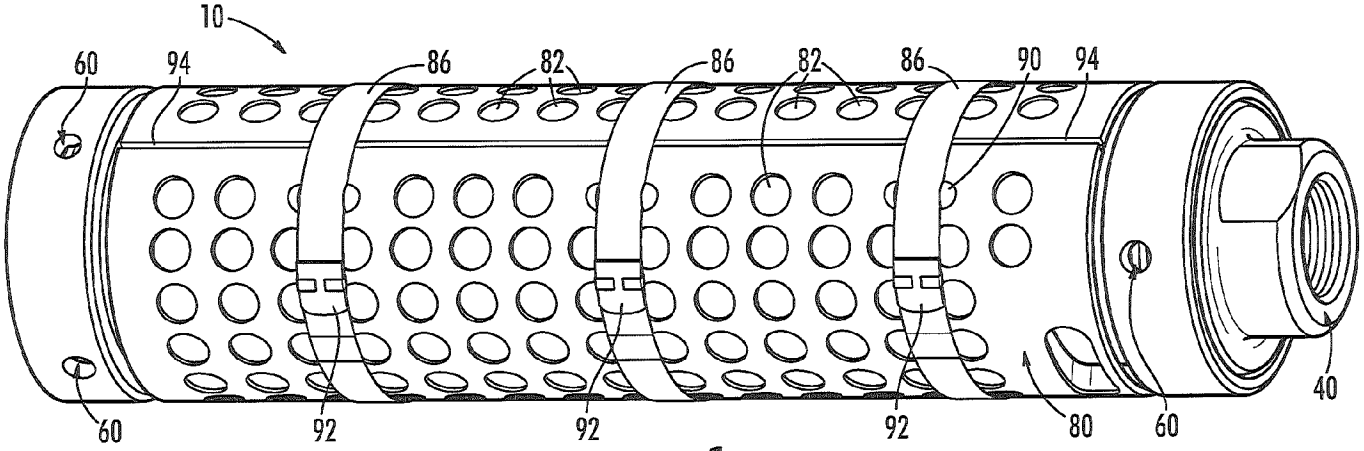
FIG. 1 is a side, exterior, perspective view of the suppressor, according to an embodiment of the present invention.

The present invention is a suppressor for use with a firearm capable of sustained fire. The present suppressor, generally indicated by reference number 10, comprises several components that can be disassembled for repair or for replacement of the individual components that are worn and reuse of the remaining components, which is a feature of the invention. Suppressor 10 includes a cylindrical baffle core 12 having a first end 24 and an opposing second end 26. The baffle core is the part most likely to require replacement inasmuch as it is exposed to the highest temperatures and bullets are fired directly through its center. Baffle core 12 serves essentially as a frame for holding a series of integrally-formed, spaced-apart baffles 16 in position with respect to the axis of rotation of baffle core 12. Baffle core 12 may be formed all of one piece by casting or machining or other convenient method of forming a three-dimensional object of homogeneous material.

Surrounding baffle core 12 is a thin metal, tubular housing 30 with a first end 34 and an opposing second end 36. Tubular housing 30 is flared outwardly at both first end 34 and second end 36. Tubular housing 30 slides over cylindrical baffle core 12, with flared first end 34 and second end 36 extending beyond first end 24 and second end 26, respectively, of baffle core 12. Housing 30 conducts and redistributes axially the heat from the baffle core and the combustion gases traveling through the spaces between its baffles.

The terms first end and second end are arbitrarily assigned here but are used consistently to refer to the direction of a bullet fired through suppressor 10. A fired bullet enters first end 24 of baffle core 24 and leaves second end 26, which means the bullet travels from right to left in FIGS. 1 and 2.

The word flared means that the diameter of cylindrical housing 30 increases closer to first and second ends 34, 36, axially lateral to first and second ends 24, 26, baffle core 12 but is constant throughout most of the length of housing 30.

An inlet nozzle 40 fits into first end 24 of baffle core 12 and an exit plate 50 covers opposing second end 26. Both inlet nozzle 40 and exit plate 50 have radial flanges, 42, 52, respectively. Flanges 42, 52, carry exterior threads and are beveled on their respective peripheries, 44, 54. The beveled portions of the peripheries 44, 54, engage the flared first and second ends 34, 36, respectively, of tubular housing 30.

Both ends of suppressor 10 also carry collars. A collar 46 threads to flange 42 and has a beveled inner surface, 48 corresponding to the beveled portion of periphery 44. Beveled periphery 44 and beveled inner surface 48 on collar 46 stop advancement of collar 46 with respect to flange 42 and capture the flared first end 34 of tubular housing 30. Tightening collar 46 pinches first end 34 against the beveled portion of periphery 44 flange 42.

A collar 56 threads to flange 52, and has a beveled inner surface 58 corresponding to the beveled portion of periphery 54 on flange 52. The beveled portion of periphery 54 on flange 52 and the beveled inner surface 58 of collar 56 stop advancement of collar 56 with respect to flange 52 and capture the flare at second end 36 of tubular housing 30. Tightening collar 56 pinches second end 36 between the beveled portion of periphery 54 of flange 52 against the beveled inner surface 58 of collar 56.

Figure 2:
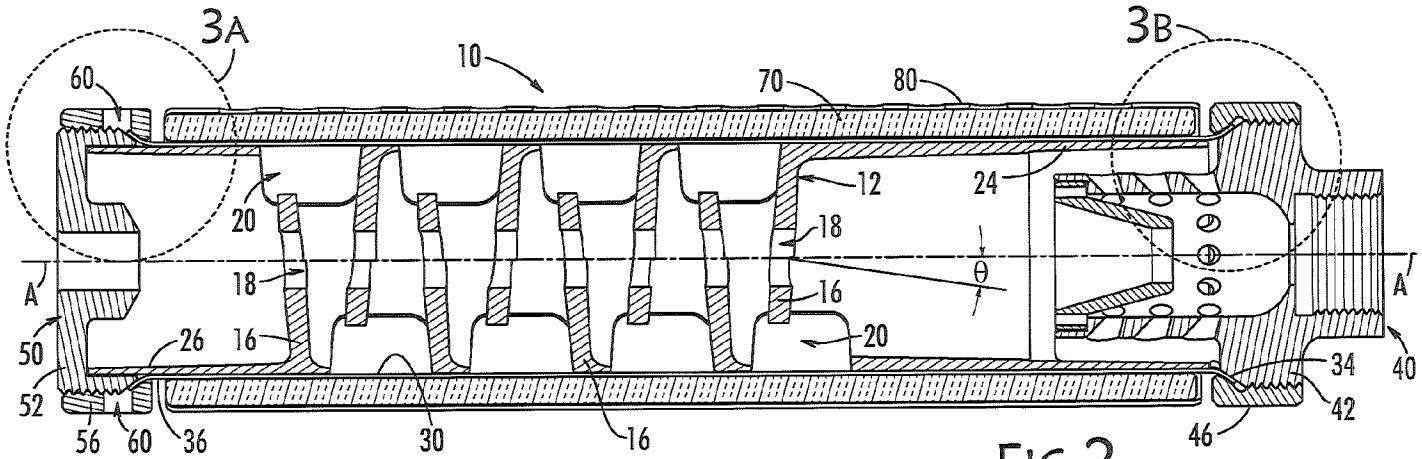
FIG. 2 is a side, cross-sectional view of the suppressor of FIG. 1.
Figure 3A:
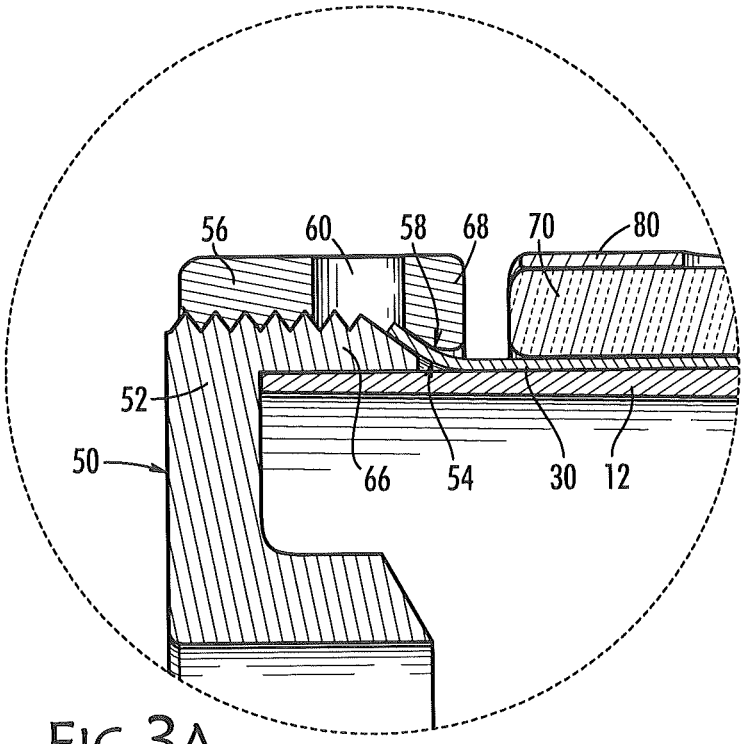
FIG. 3A and 3B are detailed side cross-sectional views of the first and second ends, respectively, of the suppressor of FIG. 1.
Figure 3B:
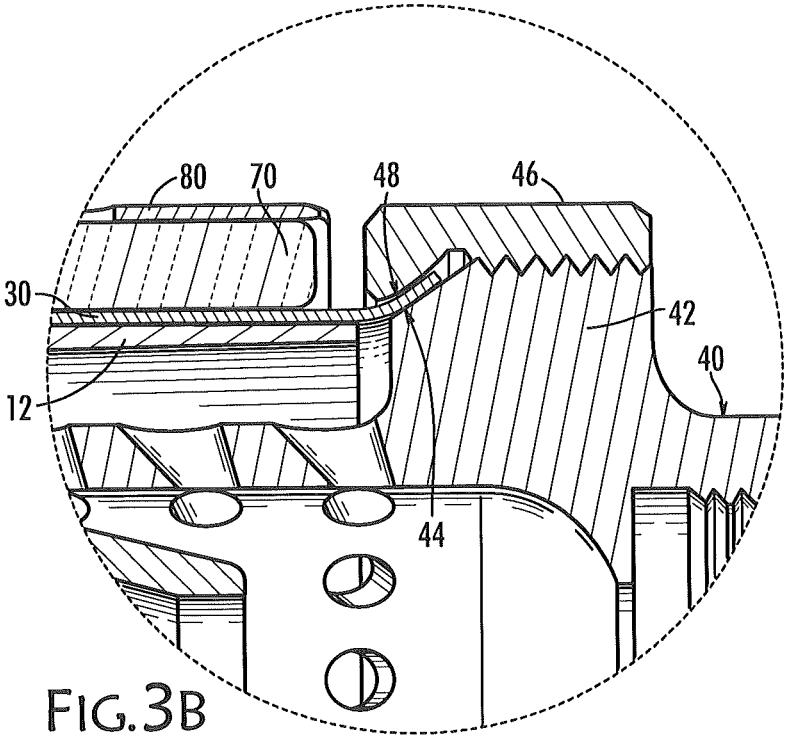

Collars 46, 56, of inlet nozzle 40 and exit plate 50, respectively, may carry surface features that facilitate their installation and removal. For example, collars 46, 56, may have opposing recesses 60, as shown in FIGS. 1 and 2, to receive the jaws of a spanner wrench, or other convenient means for tightening collars 46, 56 to flange 42 of inlet nozzle 40 and flange 52 of exit plate 50, respectively.

The flared first and second ends 34, 36 of tubular housing 30, flanges 42, 52 of inlet nozzle 40 and exit plate 50, and collars 42, 52 together with their respective threaded and beveled portions, and recesses 60 enable the present suppressor 10 to be tightly assembled for use, yet to be disassembled for maintenance and repair, thus extending the useful life of suppressor 10 and its individual components, which is a feature of the invention.

The present suppressor 10 also may include a hollow cylinder 70 surrounding tubular housing 30. Hollow cylinder 70 transfers heat generated by firing the gun radially from baffle core 12. That heat is transferred through baffle core 12 and tubular housing and then through hollow cylinder 70. This cylinder 70 may be made of graphite, such as foamed graphite, or other material with a high heat conductivity so as to transfer heat quickly away from baffle core 12 and tubular housing 30 and into the surrounding air, particularly when the firearm is being fired at high rates, in order to prevent the temperature at the exterior surface of the suppressor 10 from being elevated into the visible portion of the electromagnetic spectrum.

A thin tubular guard 80 may surround hollow cylinder 70 and have plural holes 82 formed in an array in it to protect hollow cylinder 70, especially if hollow cylinder 70 is made of friable, foamed graphite. Tubular guard 80 may have a sufficient number of holes 82 or combination of total area of holes 82 so as not block the radiation of heat while still protecting hollow cylinder. Guard 80 provides structural protection for hollow cylinder 70, which may be friable and therefore subject to damage from impact even if minor.

To secure tubular guard 80 to hollow cylinder 70, bands 86 may be used. Bands may be moved axially to capture them between raised edges 90 formed in housing that will help to keep their axial position once bands 86 are in position. Tubular guard 80 may be formed as a resilient C-shaped sheet of metal that is placed over hollow cylinder 70 and then its ends squeezed together tightly, meeting at 94, enough to allow bands 86 to be slipped into position and tightened with buckles 92. Hollow cylinder 70 may also be conveniently made in two half cylinders.

Raised edges 90 are two parallel, low-relief, radially outward deformations of the edges of holes in tubular guard 80 to form lips spaced apart by the width of a band 86 and between which band 86 will be held, prevented from axial movement, until tubular guard 80 is squeezed with enough force to enable band 86 to be moved over the raised edges 90 on one side of it or the other.

Foamed graphite is a material well known in heat transfer, including in connection with firearm barrels. See for example, US Pub. 2013/0061503 filed by UT-Battelle, LLC, and which publication is incorporated herein in its entirety by reference.

Hollow cylinder 70 and tubular guard 80 are co-axial and co-terminal with baffle core 12, that is, all stop just short of flared first and second ends 34, 36 of tubular housing 30. Co-terminal means that they are the same length and are axially aligned; co-axial means that their respective axes of rotation are the same.

Baffle core 12 includes plural, integrally-formed, spaced-apart baffles 16 each with a central hole 18 and a radial cutout 20 that define passages radially outwardly from the major axis of suppressor 10 through which combustion gases can travel from the inlet nozzle 40 to exit plate 50 and mix turbulently as they travel. Baffle core 12 is an improvement in the baffle described in U.S. Pat. No. 8,167,084, which is incorporated in its entirety by reference. By integrally formed, it is meant that baffles 16 are made of the same material and permanently connected to the balance of baffle core 12, preferably all made of one piece. Baffle core 12 has an axis of cylindrical rotation and each baffle 16 may canted with respect to that axis, that is, each may lie in a plane that is at a non-zero angle 0 with respect to to axis A of baffle core 12. The orientation of a plane is defined by a vector normal to the plane. By separating and canting each baffle 16, a portion of the combustion gases are diverted though the serpentine path across the axis of baffle core 12 and its central hole 18 and then through a radial passage 20 around each baffle 16, with the longer path and the turbulent interaction with the remaining portion of the exhaust gases that follow the bullet through the series of central holes 86, baffle core 12 acts as a heat exchanger to deliver combustion heat to cylindrical housing, which transfers it quickly to hollow core and thence to the surrounding environment.

The modularizing of the present suppressor, in combination with the choice of foamed graphite for the hollow cylinder reduces the rate at which heat accumulates during sustained firing, thereby dispersing the heat to a larger radius from the barrel and, with the larger surface area at that radius, radiating it to the surrounding air. It also reduces the temperature of the components of the present suppressor. Modularization makes it possible to replace only components damaged by a bullet strike, and thereby reduces cost of providing and maintaining a suppressor for a machine gun. For example, if baffle core 12 is damaged, but the remainder of suppressor 10 is sound, unthreading collars 46 and 56 allows release of tubular housing 30, inlet nozzle 40, and exit plate 50. Baffle core 12 may then be removed and replaced. Being able to replace a baffle core 12 enables greater use of the remaining components. Importantly, keeping the baffle core cooler limits the rate of heat deformation significantly and thereby prolongs its life and reduces the incidents of bullet strikes that require baffle core replacement.

Those skilled in the art of firearms will appreciate that many modifications and substitutions may be made in the foregoing embodiments without departing from the spirit and scope of the present invention, which is defined by the appended claims. For example, improvements in material technology may produce hollow cylinders better than foamed graphite or better ways of protecting hollow cylinders than a tubular guard, such as a coating or fine mesh of metal or fabric.

What is claimed is:

1. A suppressor for use with a firearm, said suppressor comprising:

(a) a cylindrical baffle core having a first end and an opposing second end, said baffle core including plural baffles;

(b) a tubular housing surrounding said baffle core and having a first end and an opposing second end;

(c) an inlet nozzle covering said first end of said tubular housing, said inlet nozzle having a flange enclosing said first end of said tubular housing, said flange of said inlet nozzle having exterior threads and a terminal portion;

(d) an exit plate covering said second end of said tubular housing, said exit plate having a flange enclosing said second end of said tubular housing, said flange of said exit plate having exterior threads and a terminal portion;

(e) a collar treaded to said flange of said inlet nozzle and having a terminal portion corresponding to said terminal portion of said flange of said inlet nozzle, said collar and said flange of said inlet nozzle capture said first end of said tubular housing to seal said first end of said tubular housing to said inlet nozzle;

(f) a collar threaded to said flange of said exit plate and having a terminal portion corresponding to said terminal portion of said flange of said exit plate, said collar and flange of said exit plate capture said second end of said tubular housing to seal said second end of said tubular housing to said exit plate; and (g) a hollow cylinder carried by said tubular housing;

(h) a tubular guard carried outside said hollow cylinder,; and (i) a plurality of bands securing said tubular guard to said hollow cylinder.

2. The suppressor as recited in claim 1, wherein said hollow cylinder is made of graphite.

3. The suppressor as recited in claim 2, wherein said graphite is graphite foam.

4. The suppressor as recited in claim 1, wherein said first and second end of said tubular housing are flared.

5. The suppressor as recited in claim 4, wherein said baffle core is shorter than said tubular housing so that said first and second ends extend beyond said first and said second ends of said baffle core, respectively.

6. The suppressor as recited in claim 1, wherein portions of the peripheries of said flanges and of the inner surfaces of said collars of said inlet nozzle and said exit plate are beveled, and wherein said first and second ends of said tubular housing are pinched between said beveled portions of said collars and said beveled portions of said peripheries of said flanges of said inlet nozzle and said exit plate, respectively.

7. The suppressor as recited in claim 1, wherein said tubular guard comprises a plurality of holes formed therein.

8. The suppressor as recited in claim 7, wherein said plural holes are formed in an array.

9. The suppressor as recited in claim 5, wherein said hollow cylinder and said tubular guard are co-terminal.

10. The suppressor as recited in claim 1, wherein said flange of said inlet nozzle has at least two recesses formed therein for tightening said collar against said inner portion.

11. The suppressor as recited in claim 1, wherein said flange of said exit plate has at least two recesses formed therein for tightening said collar against said inner portion.

12. The suppressor as recited in claim 1, wherein said baffles of said baffle core are integrally formed.

13. The suppressor as recited in claim 1, wherein said baffles are canted.

14. The suppressor as recited in claim 1, wherein each band of said plural bands includes a buckle to secure said band do said tubular guard.

15. The suppressor as recited in claim 1, wherein said tubular guard has raised portions for preventing axial movement of said plural bands.

* * * * *